US009687126B2

(12) United States Patent
Waikas, II

(10) Patent No.: US 9,687,126 B2
(45) Date of Patent: Jun. 27, 2017

(54) SERIES-OPERATION TOILET SYSTEM WITH HYDRAULIC SEAT LIFTING AND FLUSHING

(71) Applicant: John P. Waikas, II, Louisburg, NC (US)

(72) Inventor: John P. Waikas, II, Louisburg, NC (US)

( * ) Notice: Subject to any disclaimer, the term of this patent is extended or adjusted under 35 U.S.C. 154(b) by 0 days.

(21) Appl. No.: 14/833,622

(22) Filed: Aug. 24, 2015

(65) Prior Publication Data

US 2016/0073838 A1 Mar. 17, 2016

Related U.S. Application Data

(60) Provisional application No. 62/050,652, filed on Sep. 15, 2014.

(51) Int. Cl.
*A47K 13/10* (2006.01)

(52) U.S. Cl.
CPC ..... *A47K 13/10* (2013.01)

(58) Field of Classification Search
CPC ..... A47K 13/10
USPC ..... 4/246.2
See application file for complete search history.

(56) References Cited

U.S. PATENT DOCUMENTS 4,219,422 A * 8/1980 Knothe ..... B01D 63/14 210/137
6,907,621 B2 * 6/2005 Stemen ..... A47K 13/10 4/243.1
2013/0007952 A1 * 1/2013 Gomez-Espana Collignon ..... A47K 13/10 4/246.2
2013/0318696 A1 * 12/2013 Gomez Espana Collignon ..... A47K 13/10 4/246.2
2013/0340155 A1 * 12/2013 Gomez Espana Collignon ..... A47K 13/10 4/246.2

* cited by examiner

*Primary Examiner* — Huyen Le

(57) ABSTRACT

The invention is a series-operation seat-lifting and flush system applicable to conventional residential gravity-powered flap-released water-tank toilets. The system first lifts the seat with a hydraulic cylinder and then lowers the seat and flushes the toilet by venting the hydraulic cylinder to a mechanism connected to the flush-flap. Operation of a closed-fluid-circuit floor-trigger causes water to be diverted from the existing source of water to drive the mechanism.

20 Claims, 5 Drawing Sheets

SERIES-OPERATION TOILET SYSTEM WITH HYDRAULIC SEAT LIFTING AND FLUSHING

RELEVANT FIELDS OF ART

The invention relates to the fields of toilets, assistive devices, flushing devices, water catch cans, lever systems driven by varying or accumulating fluid loads, and water actuated pistons.

BACKGROUND OF THE INVENTION

The water-flushed toilet is one of the most significant improvements of sanitation in human history. With its proliferation, propagation of many diseases was curbed commensurately. Before the water-flushed toilet, common practice was simply to dispose liquid waste into the immediately available streets, where it would accumulate or flow into the immediately adjacent water resources. Since its use became widespread, the water-flushed toilet provided an avenue for waste to be moved to locations remote to human population centers.

However, in terms of advancing the objective of healthy home use, there remain areas that are begging for improvement. One is furthering sanitary handling of the toilet seat which sits directly over the bowl. The proximity of waste, and regular replacement of a volume of waste with fresh water creates an inviting environment for fostering bacteria colonies. Once present, each flush sends some water droplets out of the bowl and make contact with other parts of the toilet, particularly the toilet seat. Very forceful flushing, as is common in many rapid-volume flush toilets, is even more likely to send large volumes of waste-carrying droplets into the air, to deposit on the seat, and especially if the seat is not raised.

An area of the seat which is most immediately affected is the underside of the seat, which accumulates deposits earlier than the top side of the seat. Because the bottom side is negatively affected before the top, there is a potentially disproportionate exposure to users who regularly lift the seat, as compared to users who merely touch the seat by sitting upon it. Women generally sit upon the seat, while men both sit on the seat as well as stand in front of the seat. As men lift the seat more often, men are much more likely to collect deposits onto their fingers.

An especially affected scenario is in the case of a cohabiting or married man and woman. A man living alone might regularly leave the seat up, perhaps to avoid urinating upon it, while a woman living alone is more likely to regularly leave the seat down. However, when a man and a woman cohabitate, the man is expected to lower the seat, to prevent the woman from falling into the toilet bowl, if she failed to notice that the seat was up before attempting to sit on the toilet.

This scenario is a common example of an environment in which users of the toilet are exposing themselves to a higher degree of risk with respect to waste causing disease propagation. The man would regularly find himself lifting and lowering the seat, and exposing him to touching the underside of the seat at every instance in which he decides to urinate standing up. If he leaves the seat up, then the woman must touch the seat in order to lower it. As a result, cohabitation means that the total number of times that at least one of the cohabiting persons is touching the deposits is higher than the case of the man and woman living apart from one another.

Therefore, there is a need to generally decrease the number of instances in which a user might touch any part of the toilet. There is an especially high need to provide such a solution which decreases the need to make contact with the toilet seat.

SUMMARY OF THE INVENTION

The invention disclosed here addresses the problem of decreasing contact with a toilet by providing mechanisms that allow for a user to lift the toilet's seat and flush the toilet entirely without touching the toilet seat.

The mechanism which facilitates lifting a toilet seat makes use of water pressure available in the water delivered to a toilet for the ordinary purpose of operating the toilet. Thereafter, water used in the lifting mechanism is ejected from the lifting mechanism during lowering the seat and can be used to drive a second mechanism that flushes the toilet. Certainly, either mechanism might be used independently, as both are driven by water provided to the toilet, however, the best mode of the invention is one which arranges the lifting mechanism in series with the flushing mechanism, the path of water running first through the lifting mechanism and then downstream to the flushing mechanism.

One reason to use water rather than other force-conveying systems, such as a user-driven tension-carrying wire or a force-translating linkage system, is to take advantage of the force already provided to a toilet by the inflow of water pressure. The continuous availability of force from water pressure makes smooth operation of the device independent of the ability of a user to smoothly apply similarly powerful force.

Another contemplated advantage of using water is that removes the physical limitations of the user from negatively affecting the reliability of correctly using of the invention. Certainly, the physical limitations of a user weigh in favor of using an independently-available force that does not require the user to provide the forces necessary to lift a seat or flush a toilet.

DETAILED DESCRIPTION OF THE INVENTION

Figure 1:
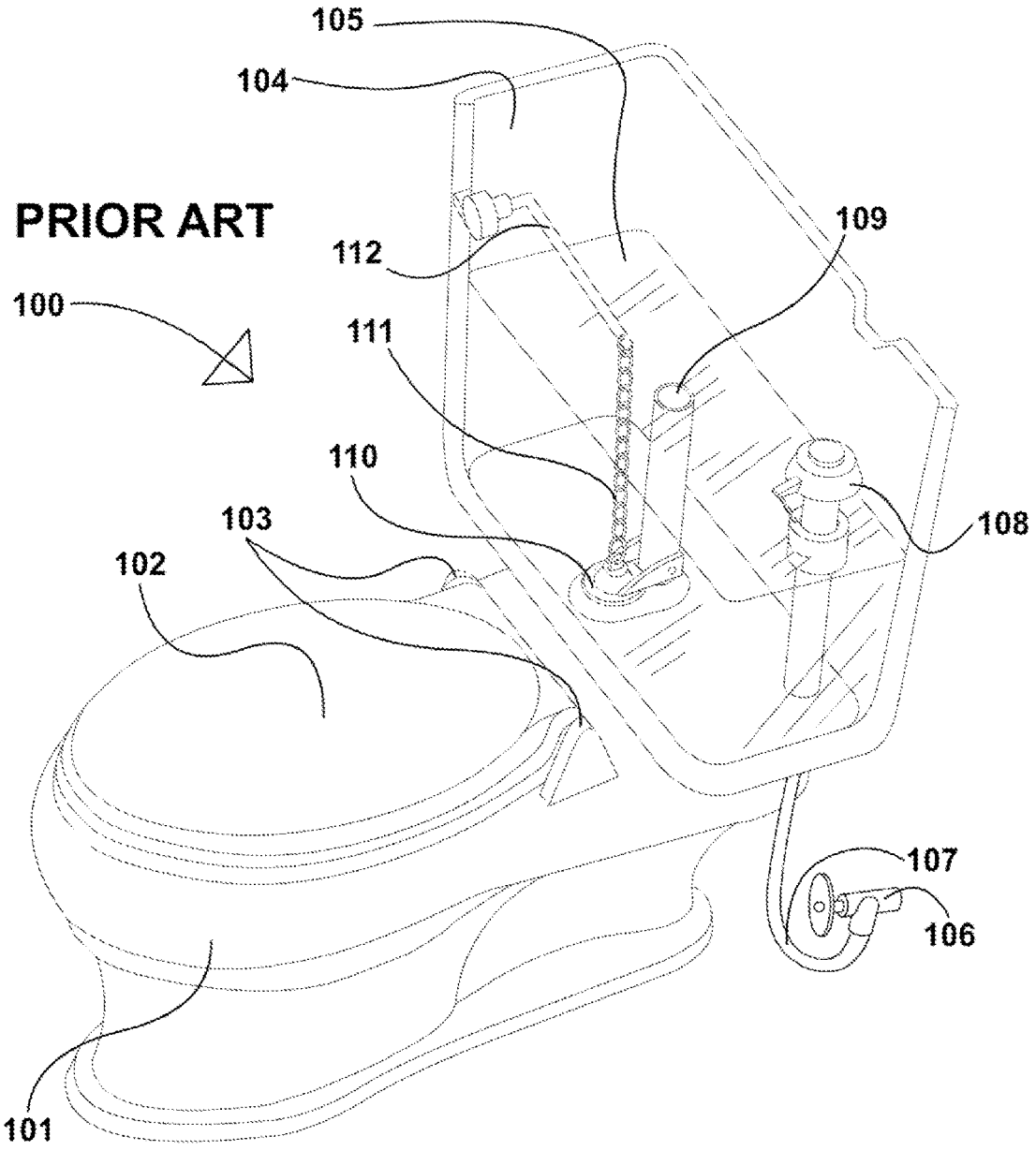
FIG. 1 shows a prior art toilet.

Referring now to FIG. 1, a prior art toilet 100 is shown. It comprises a base 101, a lid 102 connected to the base 101 by a lid hinge 103, and a tank 104, filled with water 105. The tank is fed by a water source, depicted as water spigot 106, which provides fill water to the tank 104 via a water feed line 107 and a tank fill valve 108. The volume of the water 105 retained in the tank 104 is limited by the height of an overflow tube 109, dictating the height of the water level in the tank 104. The water 105 the tank is flushable into the base 101 by lifting a tank flush flap 110. The tank flush flap 110 is connected to a flush lever 112 by a chain 111. Sufficient force applied to the flush lever 112 translates force through the chain 111 to open the flush flap 110.

FIGS. 2-5 depict toilet system embodiments of the present invention that providing lift and flush mechanisms that comprise some components similar to those found in the prior art toilet of FIG. 1, as well as fully novel components of the present invention without equivalents found in prior art toilets. Components similar to those in the prior art include base 101, seat 102, hinge 103, tank 104, water 105, spigot 106, feed line 107, overflow tube 109, and flap 110.

Toilet system 200 is shown with a sectioned view of its tank 104 to provide a better view of components applied to the tank 104. To also aid view of the present invention, some components shown in FIG. 1 have been omitted from FIGS. 2-5. Components shown in the prior art toilet system 100 that are omitted from view in FIGS. 2-5 include fill valve 108, and a primary or independently operating flush mechanism, such as flush lever 112 and chain 111, though use of these components is contemplated in most functional embodiments of the present invention.

Figure 2:
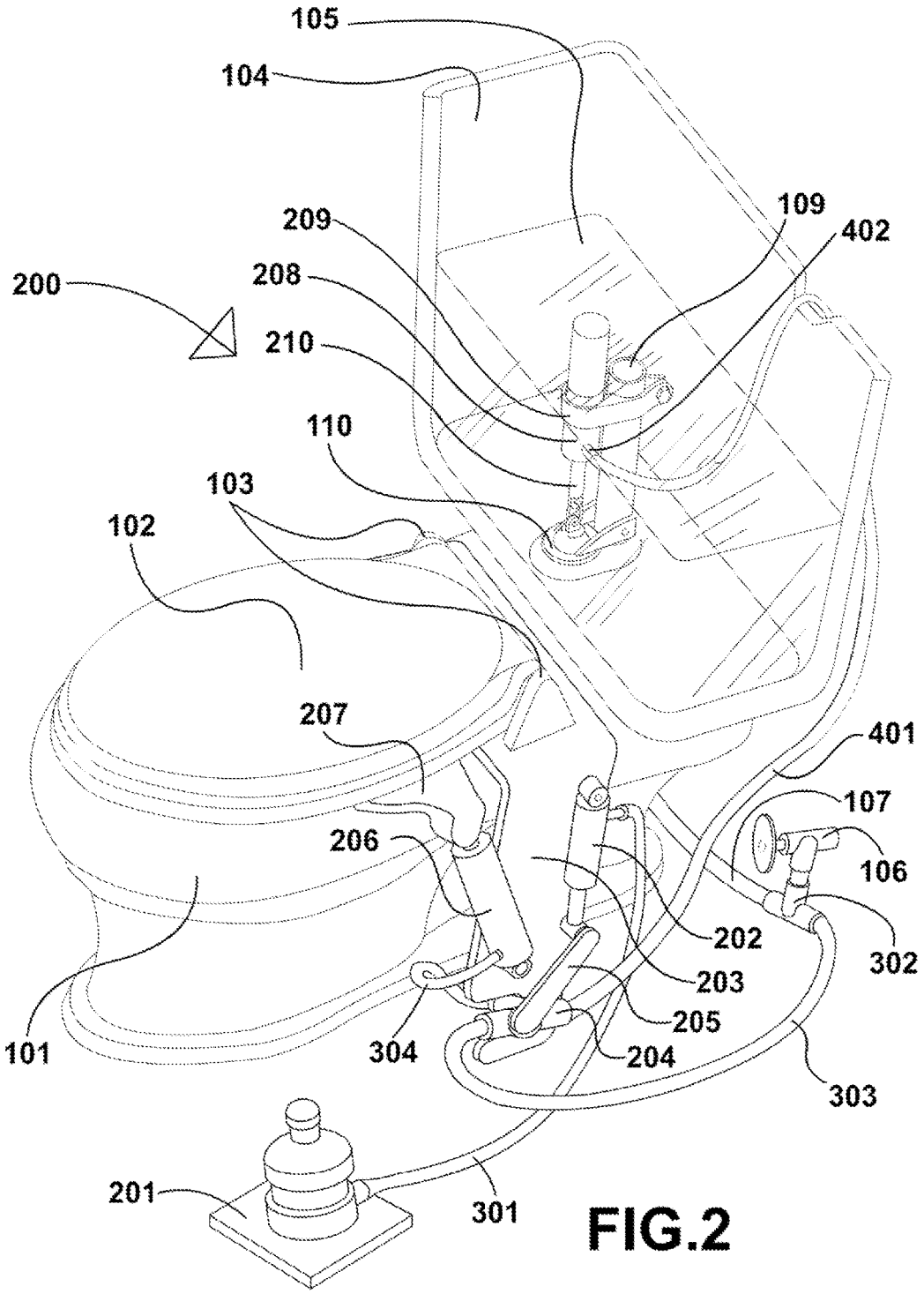
FIG. 2 shows an embodiment of the present invention as installed, at rest.

Referring now to FIG. 2, In addition to the aforesaid components which are similar to the prior art toilet 100, Toilet system 200 comprises components that are dissimilar to those found in the prior art, including a trigger button 201, an actuator 202 connected at one end to a base plate 203, and connected at its other end to a 3-way valve 204 by a valve lever 205. Base plate 203 is rigidly retained between the base 101 and the hinge 103, and three-way valve 204 is rigidly retained on base plate 203. Toilet system 200 also comprises a lift cylinder 206, pivotably connected at its lower end to the base plate 203, and pivotably connected at its upper end to a seat plate 207. The seat plate 207 is rigidly attached to the underside of seat 102.

A flushing mechanism is disposed in tank 104, comprising a piston-cylinder-type flush cylinder 208 attached to the overflow tube 109. The flush cylinder 208 is attached at its upper end to the overflow tube 109 by a bracket 209, and the pistons cylinder 208 has at its lower end a piston rod 210. The piston rod 210 is connected to the toilet tank flush lap 110.

Figure 3:
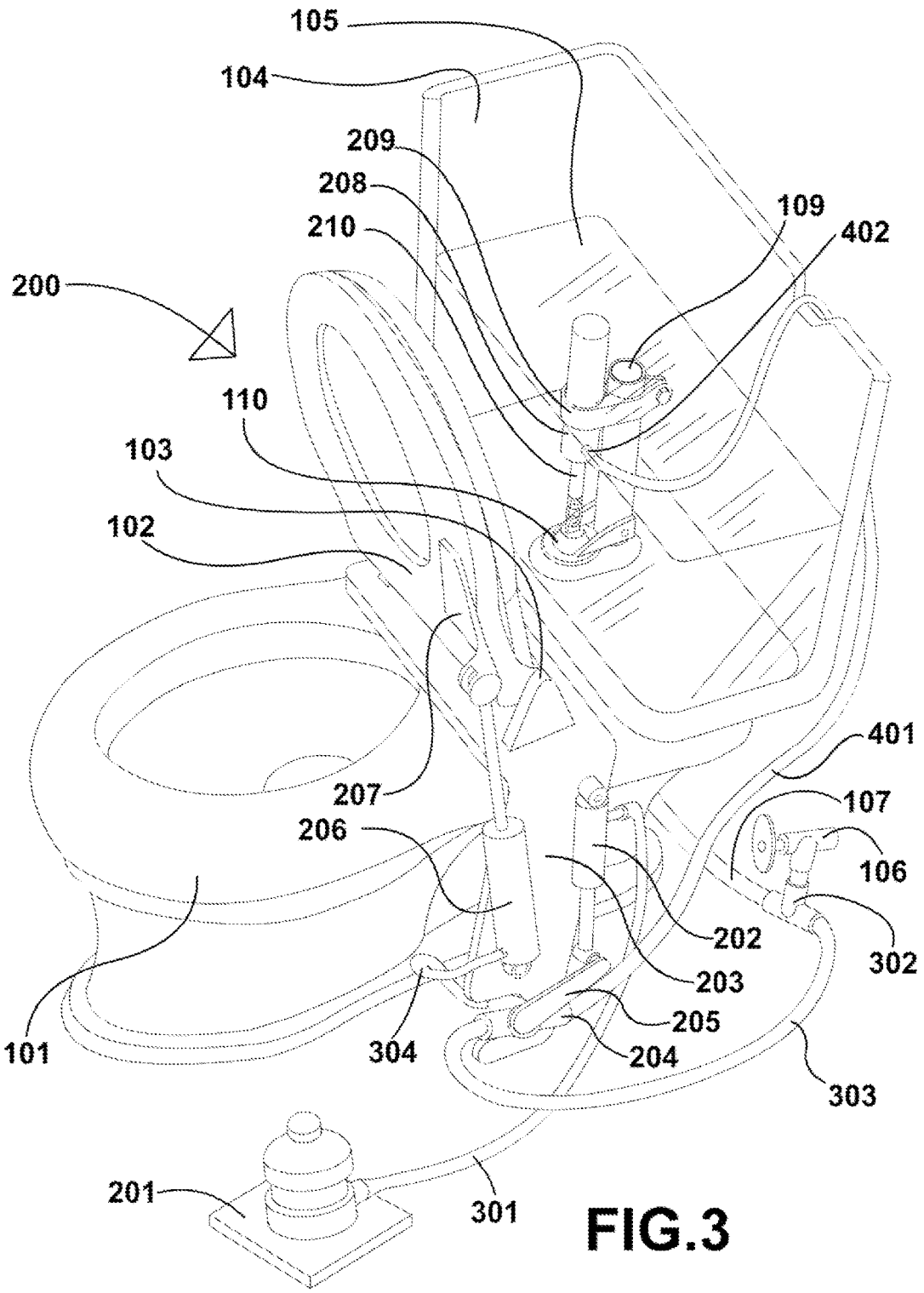
FIG. 3 shows an embodiment of the present invention as installed, a toilet-system, activated to lift.

FIG. 3 shows the lifting mechanism components, referred to above, in operation to lift the toilet seat 102 of the toilet system 200. The trigger 201 is connected to the valve actuator 202 as a closed fluid circuit by a flexible trigger line 301. The remaining componentry of the toilet system 200 is water-operated. Water is drawn from the spigot 106 by a T-fitting 302, diverting water from the fill line 107 into a cylinder fill line 303. The cylinder fill line 303 provides water to the inlet of the three way valve 204.

Depressing the trigger 201 causes a fluid in the closed circuit system to shift through trigger line 301 to the actuator 202. The actuator 202 then extends, articulating the lever 205 of the three way valve 204, opening the three way valve 204 to the lift cylinder 206. Water then passes, upon the three way valve 204 opening, from the cylinder fill line 303, through the three way valve 204, into a cylinder conduit 304. The water provided through the cylinder conduit 304 enters the lift cylinder 206 and causes the upper end of the lift cylinder 206 to extend, forcing the seat plate 207 upward.

Elevating the seat plate 207, which is pivotably connected to the lift cylinder 206, rigidly attached to seat 102, and limited to the arc of seat 102's motion with respect to hinge 103, causes seat plate 207 to pivot with respect to the upper end of the lift cylinder 206. Likewise, being rigidly attached to the seat plate 207, seat 102 thereby also pivots with respect to the upper end of the lift cylinder 206, articulating in an upward arc about its hinge 103, away from the base 101. In this moment of operation, as long as the trigger 201 remains depressed, seat 102 remains elevated. A user may then stand in front of the toilet system 200, and proceed to urinate standing up without the need to touch the toilet system 200 in order to lift and hold-up the seat 102.

Figure 4:
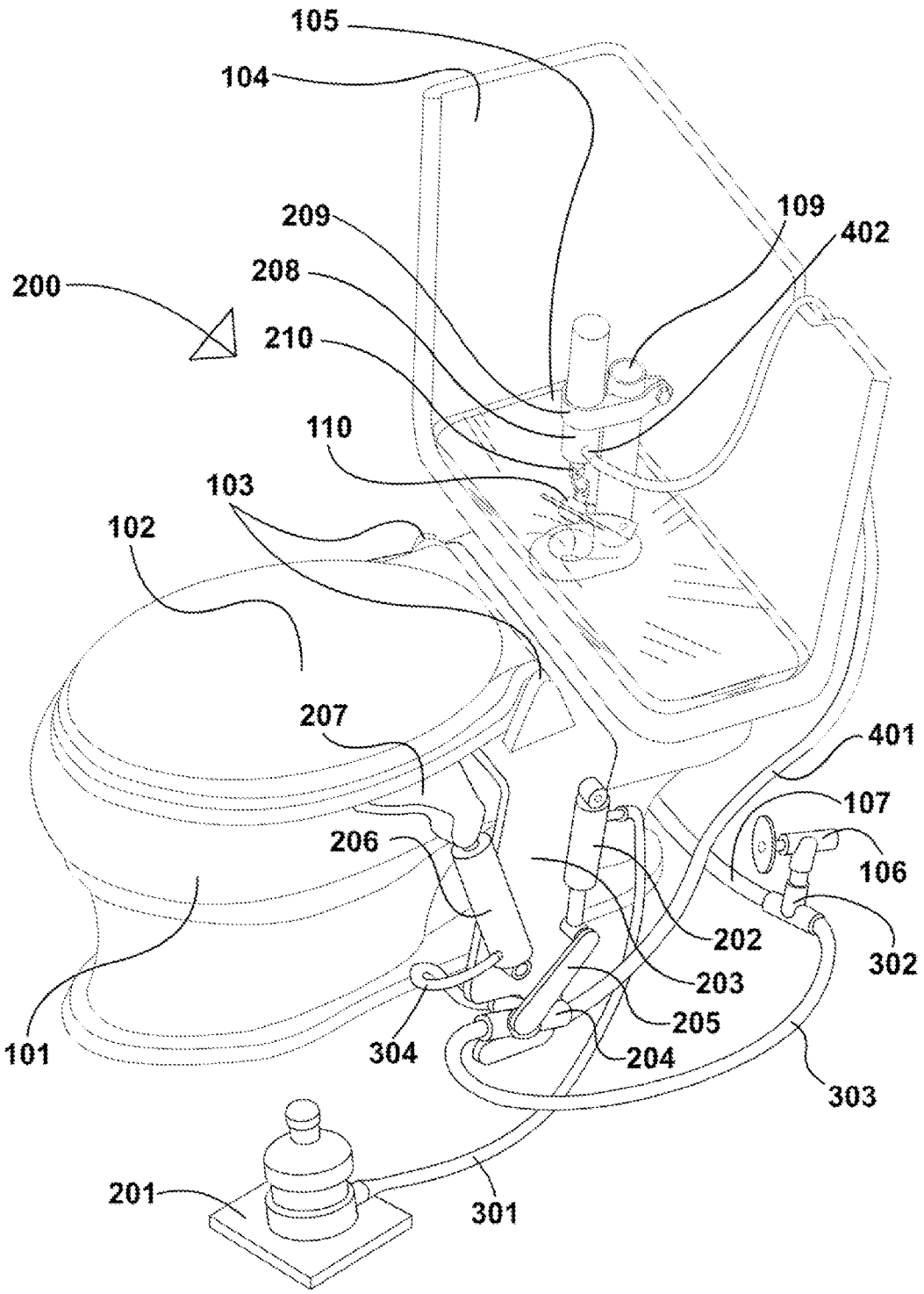
FIG. 4 shows an embodiment of the present invention as installed, activated to flush by an embodiment of the flush device comprising a piston-cylinder.

Referring now to FIG. 4, the toilet system 200 is depicted in a flushing position. The trigger 201 is released, and the fluid of the closed circuit system returns from the actuator 202 to the trigger 201 via the trigger line 301. Fluid departing from the actuator 202 retracts the actuator 202, causing the actuator 202 to articulate the lever 205 upward to its original position. Returning the lever 205 returns the three-way valve 204 to return to its original position, which closes off the cylinder fill line 303 from the cylinder conduit 304, and opens the cylinder conduit 304 to the outlet of three way valve 204.

The outlet of valve 204 is connected to a flush water line 401. By connecting the cylinder conduit 304 to flush water line 401, the water inside the lift cylinder 206 is then provided with an exit route, through the cylinder conduit 304, through the three way valve 204, and out to the flush water line 401. During its descent, the weight of the seat 102, acting on the lift cylinder 206 via the seat bracket 207, provides compressive force on the water inside the lift cylinder 206, and causes the water inside the lift cylinder 206 to exit the lift cylinder and escape through the 3-way valve 204 to the flush water line 401.

The water in flush water line 401 is carried to the tank 104, and into the flush cylinder port 402, located near the lower end of the flush cylinder 208. Water arriving into the flush port 402 fills the flush cylinder 208, lifting a piston inside the flush cylinder 208, such that a piston rod 210, connected to the piston, is retracted into the flush cylinder 208. Retracting the piston rod 210 lifts the flap 110. Lifting the flap 110 opens the tank 104 to the base 101, and the water in the tank 105 then escapes the tank 104. In this way, releasing the trigger 201 has the effect of both lowering the seat 102, and then subsequently flushing the toilet system 200 with the same water that held the lift cylinder 206 extended upward under the weight of the seat 102.

FIGS. 3 & 4 therefore disclose a toilet system 200 which can be operated entirely without hands contacting either the seat 102 or any flush mechanism in order to flush the toilet system 200.

Figure 5:
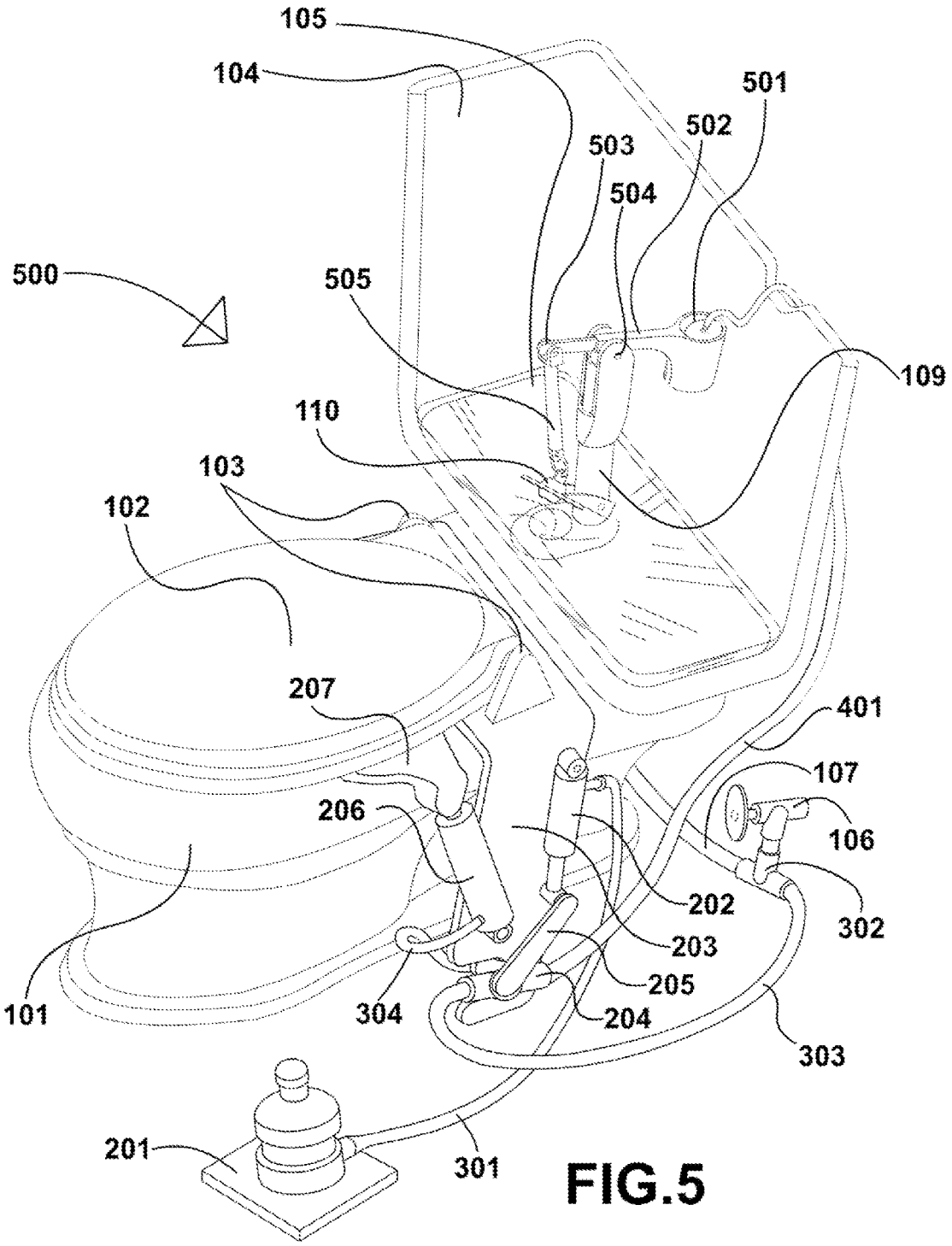
FIG. 5 shows an embodiment of the present invention as installed, activated to flush by an embodiment of the flush device comprising a fluid-cup and lever.

FIG. 5 depicts another embodiment of the present invention, a toilet system 500, comprising an alternative flush mechanism to the piston-cylinder embodiment disclosed in FIGS. 2-4. Whereas toilet system 200 makes use of the volume of the water used in the lift cylinder 206, toilet system 500 makes use of the weight of the water used in lift cylinder 206. In place of components 208, 209, and 210, toilet system 500 catches the water in a cup 501, in order to lift the flap 110 using the weight of the water arriving via flush water line 401.

The cup 501 is disposed on a first end of a lever 502, the lever 502 having a second end 503. The lever 502 pivots about a fulcrum 504 mounted atop the overflow tube 109. The second end 503 is connected to a tensile element 505. Tensile element 505 is connected to the flush flap 110 in a similar manner to that of the piston rod 210 shown in FIGS. 2 through 4, also in a similar manner to the chain 111 of FIG. 1. The water caught in the cup 501 causes a moment to be applied to the lever 502, inducing a vertical force at the second end 503.

This vertical force applies tension to the tensile element 505, causing the flap 110 to lift, thereby venting the water 105 into the base 101, flushing the toilet. As in FIGS. 2-4, FIG. 5 therefore also depicts a toilet system providing hands-free standing-use urination, by providing the shown lifting and flushing mechanisms of another embodiment of the present invention, toilet system 500.

These embodiments are not intended to limit the present invention and are purely exemplary potentially best embodiments. Other embodiments are contemplated which are primarily variations of the present invention insofar as water vented from the lift mechanism causes a flush mechanism to flush a toilet system. For example, hydraulic cylinders can also be mounted so as to lift the flap by extension, rather than retraction, and lever systems may be located in a variety of configurations, so long as water received into such a flush mechanism induces a vertical force sufficient to lift the flap. The present invention contemplates fitments to toilets using components equivalent to typical toilet flush-flap or flush-ball or other known or future flush-valve mechanisms.

I claim:

1. a seat lifting device for a toilet that has a body, said body comprising a flush-tank and a flush-flap, said toilet also having a hinged toilet seat, a flush-tank filled with water from a source of fill-water, wherein said seat lifting device comprises:
- i. a lifting system and
- ii. a flushing system, and
- b. wherein said flushing system is
- i. solely driven by a fluid
- ii. that exits said lifting system.

2. The device of claim 1, wherein
- a. said lifting system comprises:
  - i. a trigger mechanism and
  - ii. a lifter mechanism, and
- b. wherein said trigger mechanism comprises
  - i. a pedal and
  - ii. an actuator, and
- c. wherein said lifter mechanism is
  - i. fluid operated and
  - ii. comprises
    - 1. a valve and
  - iii. a lift cylinder of a conventional design having
    - 1. a piston in a cylinder-body, wherein
      - a. said piston has a piston rod
        - i. that extends out of the cylinder body, and which is
        - ii. extended or retracted relative to said cylinder body
          - 1. by an inlet of fluid,
  - iv. wherein
    - 1. said valve controls movement of fluid into said lift cylinder, and
    - 2. the lift cylinder connects between
      - a. a point located with respect to the toilet and
      - b. a point located with respect to said seat,
    - 3. such that
      - a. fluid controlled by the valve to inlet into the cylinder
        - i. extends the piston rod, and
        - ii. lifts the toilet seat with respect to the toilet.

3. The device of claim 2, wherein:
- i. said trigger mechanism is also operated by a fluid, and
- ii. said pedal
  - 1. comprises a reservoir that
  - 2. connects to said actuator by a fluid conduit, wherein
    - a. said actuator is
    - b. connected to said valve of said lifter mechanism,
    - c. such that
      - i. use of the pedal
        - 1. causes a fluid in the fluid reservoir to
        - 2. pass through the fluid conduit and
        - 3. drive said actuator to operate said valve.

4. The device of claim 3, wherein said fluid of said lifter mechanism is water.

5. The device of claim 4, wherein said fluid of the lifter mechanism is water is provided by said source of fill-water of said toilet and wherein said water is received by said lifting system by an inlet line that connects to said valve.

6. The device of claim 5, wherein said valve also connects to an exit line.

7. The device of claim 6, wherein said valve controls water to enter said lift cylinder by being operated by said valve actuator to allow water from said inlet line pass into said lift cylinder.

8. The device of claim 7, wherein said valve controls water to exit said lift cylinder by being operated by said valve actuator to attain a state that allows water in said lift cylinder to pass into said exit line.

9. The device of claim 8, wherein said exit line connects to said flushing mechanism.

10. The device of claim 9, wherein said flushing mechanism is connected to said flush-flap, wherein water passed from said exit line is received into a vessel, such that at least one property of said received water is leveraged against a holding force that holds said flush-flap closed.

11. The device of claim 10, wherein said at least one property of said received water used by said flushing mechanism comprises the weight of said received water.

12. The device of claim 11, wherein
- a. said vessel that received water
  - i. is positioned on a lever, and
  - ii. uses the vertical force provided by the weight of said received water to provide a weight-force:
    - 1. with respect to a fulcrum
    - 2. to provide an opposition force against said holding force, and
    - 3. wherein a sufficient amount of weight of received water effects an opposition force of a magnitude sufficiently greater than said holding force to open said flush-flap.

13. The device of claim 12, wherein
- a. said vessel is a catch cup,
- b. said fulcrum is a pivot point provided by a bracket
  - i. mountable with respect to a component located on or in the flush-tank,
- c. said lever is a beam
  - i. mounted to said pivot point
  - ii. extending a significant length on both sides of said pivot point
  - iii. to provide opposing sides,
    - 1. a weight side and a tension side,
  - iv. wherein said catch cup has a position on the weight side, and
  - v. wherein an element that provides a tension-path to said flush-flap is located at a position on the tension side.

14. The device of claim 13, wherein said trigger mechanism is a closed system in which said fluid of said trigger mechanism is contained within the mechanism and is limited to valve actuator designs that can pass force to the lifter mechanism, to operate said valve, but which do not pass fluid to the lifter mechanism, such a piston-cylinder design.

15. The device of claim 10, wherein said at least one property of said received water used by said flushing mechanism comprises the generally incompressible density and the volume of said received water.

16. The device of claim 15, wherein:

a. said vessel is a flush-cylinder of a general piston-cylinder design, i. mountable with respect to said flush tank, such as by attachment to an overflow tube, or other component located on or in the flush-tank, to a position that is close enough to said flush-flap to provide a substantially vertical force-path, ii. wherein said water received into said flush-cylinder introduces a volume of generally incompressible density between a flush-piston inside said flush-cylinder and an interior end of said flush-cylinder, iii. such that 1. said flush-piston moves with respect to said flush-cylinder as to move a flush-piston-rod attached to said piston, and 2. such that a tensile element that connects said piston-rod to said flush-flap is moved until it is drawn taught, and 3. wherein a sufficient volume of received water imparts a tensile force on said rod as to provide an opposing force at said flush-flap to effects an opposition force of a magnitude sufficiently greater than said holding force to open said flush-flap.

17. The device of claim 16, wherein said trigger mechanism is a closed system in which said fluid of said trigger mechanism is contained within the mechanism and is limited to valve actuator designs that can pass force to the lifter mechanism, to operate said valve, but which do not pass fluid to the lifter mechanism, such a piston-cylinder design.

18. A toilet seat lifting device for a water-operated toilet that is fed by a toilet-fillwater-line and which has a bowl-body, a seat, a flush-tank, and a flush port, comprising:

a. A closed-hydraulic-fluid circuit, comprising a foot trigger, a valve-actuating cylinder, and a single hydraulic line connecting the foot trigger to the valve-actuating cylinder, b. A hydraulic lifting cylinder, having a single fluid inlet and exit port, located at one end to the bowl-body of said toilet, and connected at the opposite end to seat of said toilet, wherein said lifting cylinder is connected at its fluid port to a three-way valve, wherein said three-way valve is alternately positionable by a lever to connect said lifting cylinder to either an inlet water line fed by said toilet-fillwater-line or an exit water line, wherein said valve-actuating cylinder is connected to said lever to alternately position said lever to connect said lifting cylinder to either said inlet line or said exit line, and c. a flush mechanism located in said flush-tank, connected to said exit line, powered by water delivered to said mechanism by said exit line, to open the flush-port of said toilet.

19. The device of claim 18, and additionally:

a. Wherein said flush mechanism is a lever-operated system connected to said flush-port, comprising a lever having a first end and a second end, a catch cup, a fulcrum, and a chain connected to said flush-port, wherein said catch cup is disposed on said first end, said chain is connected to said second end, and said lever pivotably mounted to said fulcrum, wherein said exit line is located with respect to said catch cup such that water delivered by said exit line would be deposited into said catch-cup, and wherein said lever, fulcrum, catch cup, chain, and flush-port are positioned such that the weight of said catch cup and any water deposited into said catch cup would pull said chain or place the chain in tension between said second end of said lever and said flush-port.

20. The device of claim 18, and additionally wherein:

a. said flush mechanism is a piston-cylinder system connected to said flush-port, comprising a chain, a piston, a piston rod having a piston-end, a chain-end, and an integrated exit feature in the form of a groove cut radially into said piston rod, a chain, and a cylinder body having a first end, an inlet port and a second end, said second end having an exit aperture, wherein said inlet port is located near said second end, said exit line is connected to said inlet port, said piston is disposed concentrically within said cylinder body at a location which is between the location of said inlet port and said first end, said piston rod abuts at its piston-end and is rigidly connected to said piston, wherein said piston-end remains inside said cylinder body, and extends through said exit aperture, said exit aperture being marginally larger than the thickness of said piston rod, and terminates outside said cylinder body at said chain-end and said chain connected to said chain-end and said flush-port, such that water deposited into said cylinder body would enter the volume between said second end and said piston, such that said piston and piston rod would pull said chain or place the chain in tension between said chain-end and said flush-port, and wherein water may exit from said cylinder body through a space defined by the shape of the groove and the periphery of said exit aperture adjacent to said groove.

* * * * *